US007134574B2

(12) United States Patent
Braunstein et al.

(10) Patent No.: US 7,134,574 B2
(45) Date of Patent: Nov. 14, 2006

(54) INTEGRAL POUR SPOUT FOR PAINT CANS AND SIMILAR CONTAINERS

(76) Inventors: Richard Braunstein, 3350 E. Terrell Branch Ct., Marietta, GA (US) 30067; Gregory Blake McKenna, 5715 Cherokee Trace, Cumming, GA (US) 30041; Trevor Irvin, 330 Southerland Ter., Atlanta, GA (US) 30307

( * ) Notice: Subject to any disclaimer, the term of this patent is extended or adjusted under 35 U.S.C. 154(b) by 473 days.

(21) Appl. No.: 10/662,843

(22) Filed: Sep. 15, 2003

(65) Prior Publication Data

US 2004/0065698 A1 Apr. 8, 2004

Related U.S. Application Data

(60) Provisional application No. 60/411,523, filed on Sep. 19, 2002.

(51) Int. Cl.
*B65D 25/48* (2006.01)
*B67D 3/00* (2006.01)
*B67D 5/60* (2006.01)

(52) U.S. Cl. ..... 222/108; 222/143; 222/539; 222/570; 222/571

(58) Field of Classification Search ..... 222/566, 222/538, 539, 143, 567, 570, 571, 541.6, 222/188, 108
See application file for complete search history.

(56) References Cited

U.S. PATENT DOCUMENTS 369,975 A * 9/1887 Simon ..... 213/105
2,873,881 A * 2/1959 Nichols ..... 220/697
3,980,213 A * 9/1976 Ramsay ..... 222/485
4,083,653 A * 4/1978 Stiffler ..... 416/142
4,240,568 A * 12/1980 Pool ..... 222/189.07
4,784,260 A * 11/1988 Holben ..... 206/223
4,811,865 A * 3/1989 Mueller et al. ..... 222/153.08
5,161,689 A * 11/1992 Balson ..... 206/509
5,669,526 A * 9/1997 Keyfauver ..... 220/696
5,730,331 A * 3/1998 Johnson ..... 222/143
6,702,144 B1 * 3/2004 Lyon ..... 220/700

* cited by examiner

*Primary Examiner*—Joseph A. Kaufman
(74) *Attorney, Agent, or Firm*—Glenn E. Klepac

(57) ABSTRACT

An improved resilient pour spout for paint cans and similar containers that seals off the groove into which the lid of the container mates while preventing the liquid contents from flowing down the surface of the container. When not in use, the spout is stored on the sealed container in an inverted position so as not to take up additional space on the storage shelf. In this position, the trough of the spout will be tight against the container while its exposed outer surface provides a surface for retailers to display advertising. The spout also acts as a base for a second container that may be stacked concentrically above, thereby safely and neatly interconnecting the two containers. The pour spout has the option to be molded in a set so as to provide a carrier for the bulk shipment of several containers thereby reducing the cost of packaging.

20 Claims, 8 Drawing Sheets

INTEGRAL POUR SPOUT FOR PAINT CANS AND SIMILAR CONTAINERS

CROSS-REFERENCE TO RELATED APPLICATIONS

Priority is claimed under 35 U.S.C. 120 based upon Provisional Application #60/411,523, Sep. 19, 2002

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention relates generally to assist in pouring a liquid, such as paint, from a can. More specifically, the present invention relates to an integral pour spout mounted flush with the can so as to provide a means to facilitate vertical storage and shipping as well as a surface to display graphics.

It is well known that the standard paint container consists of a one-gallon can with a metal press-on lid. This lid has a formed flange that fits into a circular groove around the circumference of the container thereby sealing the paint within. After removal of the lid, paint may be poured out of the can or a brush may be dipped into the paint whereby removing the paint directly from the can. In both instances, paint is inadvertently transferred into the circular groove that accepts the lid. This paint must be adequately removed from the groove prior to engaging the formed flange of the lid. If this is not done, the paint will likely harden around the flange of the lid making it difficult to remove when re-opening. In addition, while pouring paint from a can, the paint is susceptible to dripping down the exterior surface of the can. It is known that a lip to assist in pouring paint can be attached around the circumference of the container to prevent paint from being transferred into the groove. For example, U.S. Pat. No. 3,894,650 to Crump, U.S. Pat. No. 4,240,568 to Pool, U.S. Pat. No. 5,012,960 to Arnold, U.S. Pat. No. 5,641,089 to Palank, and U.S. Pat. No. 6,253,951 to Pruckler disclose an annular ring that attaches to the open rim of a can. While these devises will prevent the liquid contents from entering the groove around the top of the container they will not prevent the liquid contents from dripping down the exterior surface of the can.

As an alternative to protecting only the rim of the can, several other patents disclose a means of attaching a spout to one side of the rim. For example, U.S. Pat. No. 1,952,288 to Saxon, U.S. Pat. No. 2,767,891 to Beadles and U.S. Pat. No. 5,195,662 to Neff disclose a means of attaching a U-shaped trough to the open rim of the can. While these devises will assist in pouring the liquid from the container, they suffer the disadvantage of leaving the remaining rim and groove of the can unprotected and susceptible to paint transfer.

Several patents have combined the benefits of protecting the groove while providing a spout to assist in pouring the liquid from the container. For example U.S. Pat. No. 4,203,537 to McAlister, U.S. Pat. No. 4,907,714 to Gatz and U.S. Pat. No. 5,234,133 to Kensey disclose an annular rim for protecting the groove that combines a pour spout. In all cases, the prior art suffers the disadvantage of a spout that has to be removed from the top of the can and stored separately from the can itself when not in use. This takes up additional storage space and could result in misplacement of the spout if not stored in close proximity to the can.

Several patents have attempted to address the issue of storage. For example U.S. Pat. No. 2,720,346 to Compton discloses a method to store a spout on the exterior of a container in the inverted position by utilizing pressure adhesive tabs. U.S. Pat. No. 3,221,955 to Banaszak utilizes an integral clip that is adapted to be snapped onto the outer edge of the container so the attachment may be stored with the container in a hanging position. U.S. Pat. No. 3,239,113 to Knize engages the entire rim of the container and acts as a new attachment base for the press-on lid. Finally, U.S. Pat. No. 3,469,735 to Burt discloses a means to store a protector of the container rim in the inverted position by engaging with the metal press-on lid. These patents demonstrate a need for a spout that is stored directly on the can to reduce the possibility of the spout being lost or misplaced. However, in each case the attachment takes up additional storage space on the container and has the disadvantage of not being able to accommodate the storage of additional containers.

Paint containers are typically stacked in the retail store, one on top of the other. The containers do not interlock so this structure becomes unstable and creates a safety concern if more than a couple of cans are stacked together. It is very difficult and time consuming for stock personnel to stack the containers concentrically on top of one another so it is seldom done. The visual image of paint containers precariously stacked one on top of the other, is one of disorder creating an unkempt appearance. It has been demonstrated by U.S. Pat. No. 3,173,574 to Goldsmith, U.S. Pat. No. 3,913,785 to Pattershall and U.S. Pat. No. 3,980,213 to Ramsay that by attaching a properly formed cover or lid to the opening of a container it is possible to stack additional containers in a stable position above. Thus there is a further need for an integral spout that allows a means of alignment of the paint containers so that they may be stacked concentrically on top of one another while structurally interlocking.

Paint containers are shipped for retail distribution in bundles. For single gallon containers a bundle generally consists of four cans packaged in a box or in a cardboard tray. The boxes and trays can then be palletized for bulk shipments. The cardboard that makes up the boxes and trays is expensive. In addition, the boxes take up a lot of space when discarded and result in material waste. It is well known that cylindrical containers can be combined together such as in a six-pack of beverage cans. Such a multi-packaging device is disclosed in Pat. No. 4,462,494 to Cunningham. Thus there is an additional need for an inexpensive method of packaging the paint containers that will also eliminate the volume of cardboard waste that currently exists.

Another device used by painters is a stirring stick used for mixing paint. These include hand held mixing paddles as well as devices that are inserted into electric hand drills. Such drill operated devises are disclosed in U.S. Pat. No. 3,733,645 to Seiler and U.S. Pat. No. 4,083,653 to Stiffler. Thus there is a further additional need to provide such a mixing device integral with the spout attachment.

The paint container and lid are very generic in construction. One paint manufacturer may use a container that is indistinguishable from another paint manufacturer. The only distinguishing element on the container is the label, which typically encircles the entire can from top to bottom. This label leaves little or no room on the container for the retailer to display a trademark, logo and the like. In addition, once the paint leaves the retail store, the identity of where the paint was purchased has been lost. Thus there is a need for integral graphics which can be applied to the container without altering the manufacturer's label so as to display the retailer's trademark, logo and the like.

BRIEF SUMMARY OF THE INVENTION

Stated generally, the present invention consists of a pour spout to assist in pouring liquids such as paint from a can. A component of the spout is extended around the entire circumference of the can to protect paint from entering the groove, which is occupied by the lid when the can is closed while providing a means to clean excess paint off a brush. The spout is stored in an inverted position directly on top of the can when not in use so as to reduce the likelihood of being lost or misplaced. The spout will also facilitate stacking of additional paint cans directly on top by providing a vertical lip that structurally interlocks the cans. The spout additionally provides a means of bundling several containers together for bulk shipments. The spout further provides a surface onto which graphics can be displayed.

Stated somewhat more specifically, the present invention consists of a downward facing circular channel that engages the exposed rim at the top of a container such as a paint can once the lid has been removed. The channel completely covers the entire circumference of the can and protects paint from entering the groove, which is occupied by the lid when the can is closed. Approximately halfway around the circumference, a trough to assist in pouring liquid from the can extends upward, perpendicular to the web, at the outer edge of the channel and is curved on a radius that is slightly larger than the radius of the can. On the remaining half of the circumference, a lip to assist in cleaning off excess liquid or paint from a brush extends inward in the same plane as the web of the channel. This lip may include a further extension to be used as a pull-tab for removal of the spout from the container. In addition, a smaller flange extends upward in the same relation as the trough so that if the spout is removed from the top of the can and inverted it will fit snugly over the top of the can once the lid has been replaced. To reduce storage space, the spout may be placed in this inverted position. While in the inverted position, the outermost exterior flange of the channel extends upward; thus enabling additional cans to be stored concentrically and directly on top. Several spouts can be manufactured so that they are interconnected to form a structural framework. When the interconnected spouts are placed in the inverted position on a like number of containers, the structural support created at the top of the containers enables the cylinders of the containers to be bound together inexpensively with a material such as plastic shrink wrap. In addition, with the spout in the inverted position, graphics, such as the name or logo of a retail store, may be displayed on the exterior surface of the lip.

Thus it is an object of the present invention to provide an improved pour spout for paint cans and the like which assists in the transfer of liquid from the can while keeping the rim and exterior surface dry and free from the liquid.

It is a further object of the present invention to provide a means whereby the spout can be easily and cleanly removed and conveniently stored on the can when not in use.

It is another object of the present invention to provide for an integral means of vertical storage of additional paint containers so that they can be stacked concentrically on top of one another while interlocking structurally.

It is another object of the present invention to provide a means whereby the spout can be interconnected during manufacture so as to provide a structural framework for bundling several containers together for bulk shipments so as to reduce the cost of packaging. The addition of a four-blade stir paddle may be incorporated into the structural framework to help support the cans in the bundled position.

Still another object of the present invention is to provide a surface for integral graphics which can be applied to the container without altering the manufacturer's label so as to display the retailer's trademark, logo and the like.

Other objects, features, and advances of the present invention will become apparent upon reading the following specification, when taken in conjunction with the drawings and appended claims.

DETAILED DESCRIPTION OF THE INVENTION

Figure 1:
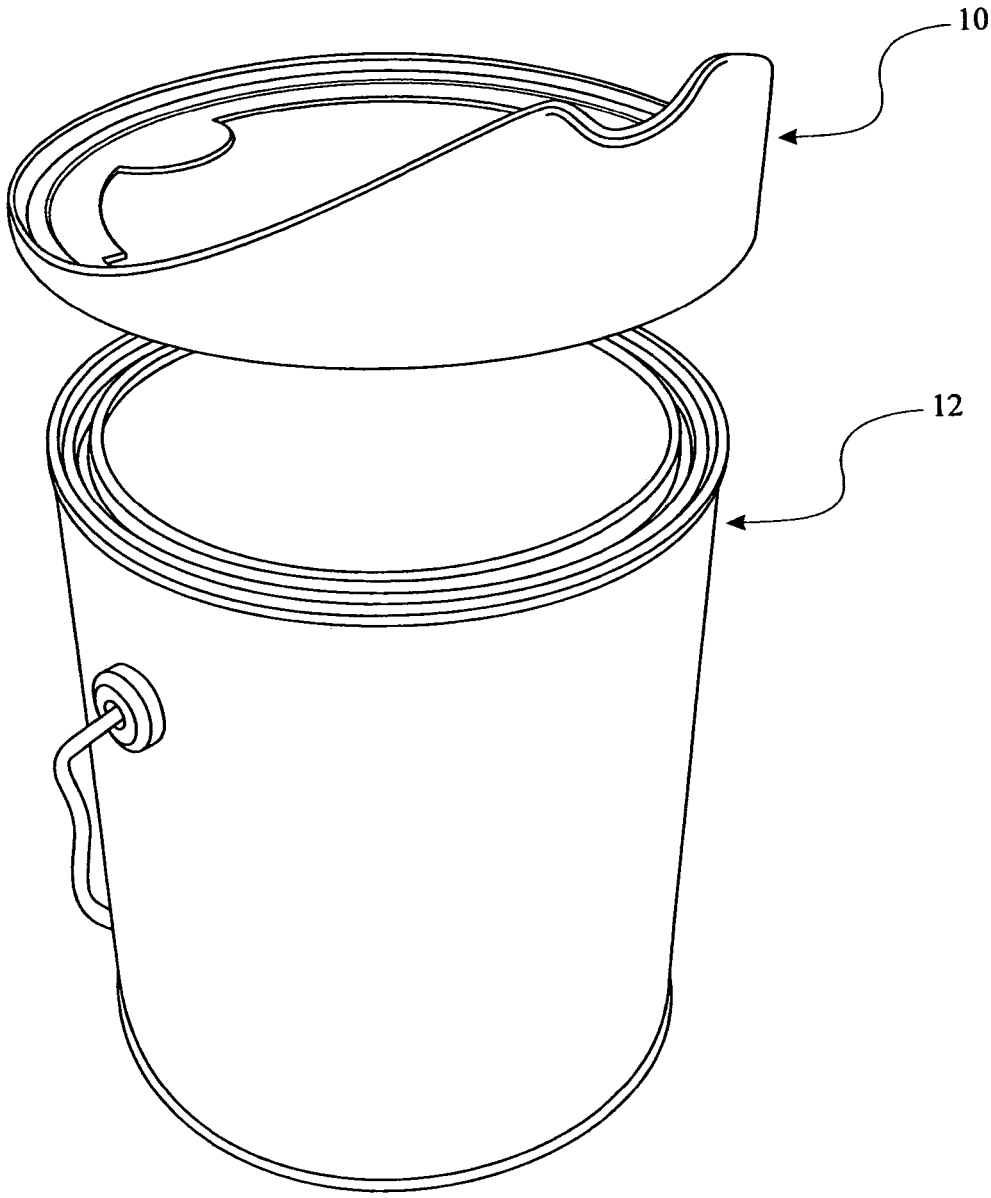
FIG. 1 is an exploded perspective view of the spout according to the present invention.
Figure 2:
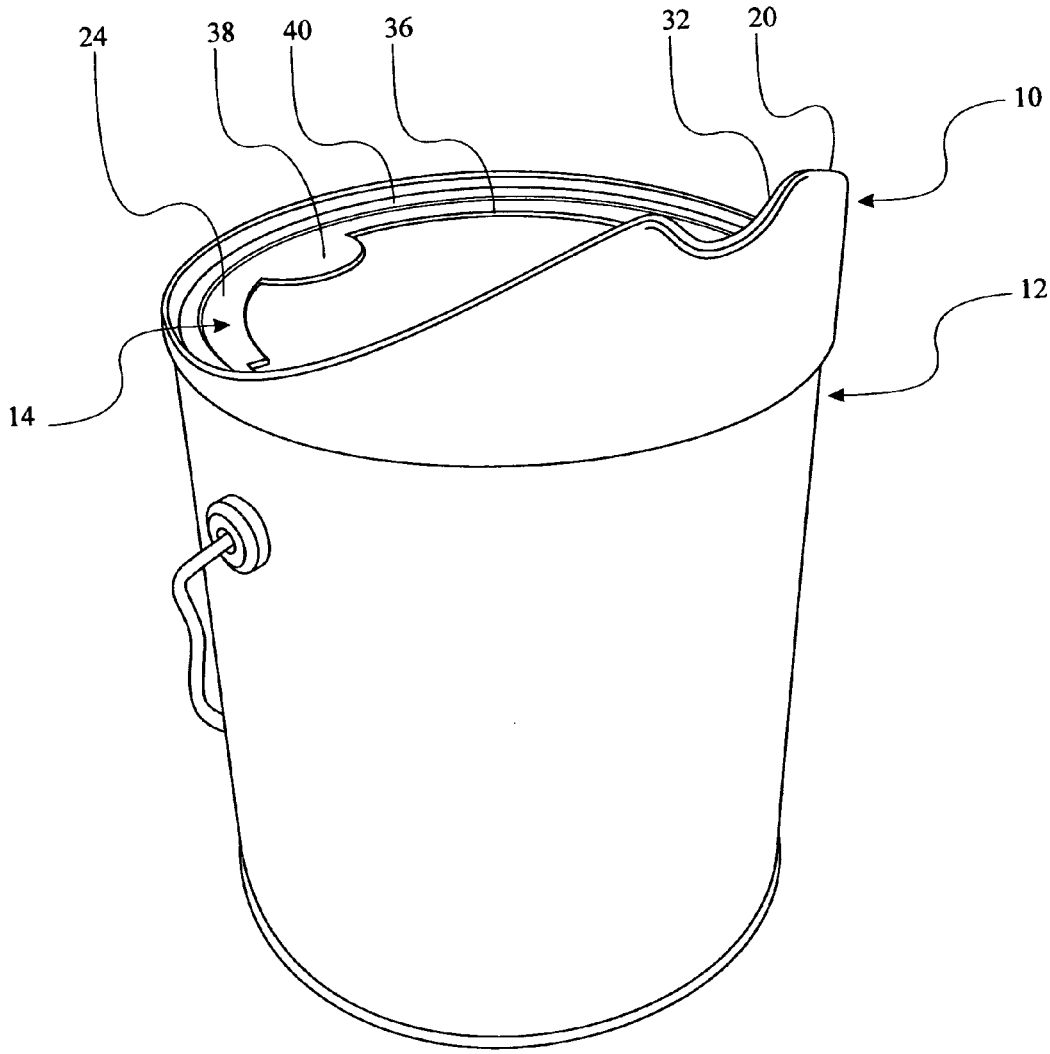
FIG. 2 is a perspective view of the spout shown in the pour position.
Figure 3:
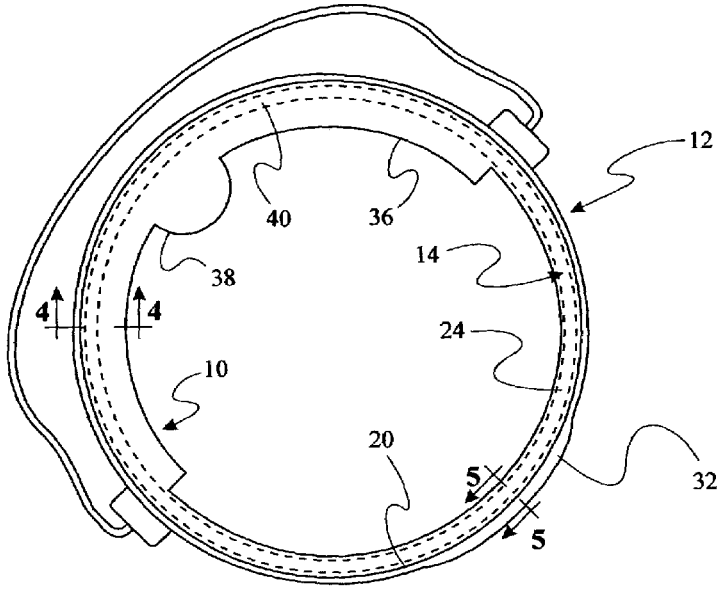
FIG. 3 is a top view of the spout shown in the pour position
Figure 4:
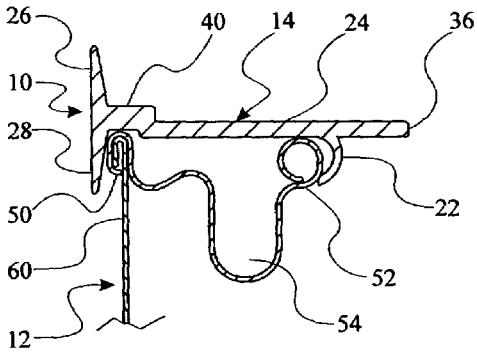
FIG. 4 is a sectional view along line 4—4 of FIG. 3.
Figure 5:
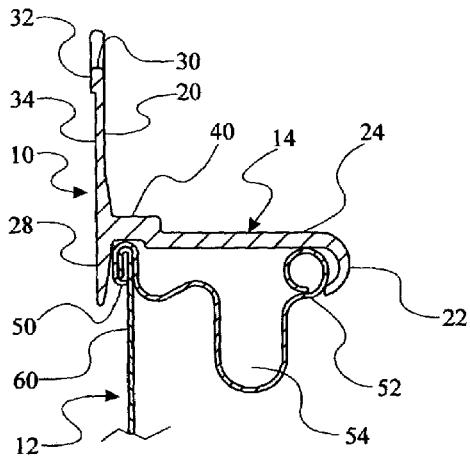
FIG. 5 is a sectional view along line 5—5 of FIG. 3.

Referring now to the drawings, in which like numerals indicate like elements throughout several views. FIG. 1 depicts a pour spout 10 and its relationship to a paint container 12 onto which it will engage. FIG. 2 and FIG. 3 depict the present invention in the pour position. The pour spout 10 of the preferred embodiment is comprised of polypropylene, though other types of flexible and resilient plastic or rubber based materials are also suitable. The pour spout 10 consists of a circular channel cover 14, a pour trough 20 and a control trough 30. The circular channel cover 14 consists of three horizontal surfaces: the rim channel protector 24, the stacking spacer 40 and the brush wipe 36. The pour spout 10 is removed from the paint container 12 by pulling up on the pull-tab 38. This will disengage the circular channel cover 14 closest to the pull-tab 38. As the pull-tab 38 is pulled further, the circular channel cover 14 continues to disengage until the pour spout 10 is completely removed. When the pour spout 10 is installed in the pour position as shown in FIG. 4 and FIG. 5, the rim channel protector 24 and stacking spacer 40 seal off the rim channel 54 and eliminate the possibility of paint from entering. The brush wipe 36 is a horizontal extension of the rim channel protector 24 but is present only in two places around the inner circumference of the pour spout 10. The two brush wipes 36 are separated by the pull-tab 38 and cover approximately 90 degrees around the inner circumference of the pour spout 10. The brush wipes 36 extend inward toward the center of the circle and provide a stiff edge on which to remove excess paint from a brush. pull-tab 38. This will disengage the circular channel cover 14 closest to the pull-tab 38. As the pull-tab 38 is pulled further, the circular channel cover 14 continues to disengage until the pour spout 10 is completely removed. When the pour spout 10 is installed in the pour position as shown in FIG. 4 and FIG. 5, the rim channel protector 24 and stacking spacer 40 seal off the rim channel 54 and eliminate the possibility of paint from entering. The brush wipe 36 is a horizontal extension of the rim channel protector 24 but is present only in two places around the inner circumference of the pour spout 10. The two brush wipes 36 are separated by the pull-tab 38 and cover approximately 90 degrees around the inner circumference of the pour spout 10. The brush wipes 36 extend inward toward the center of the circle and provide a stiff edge on which to remove excess paint from a brush.

Two flanges 22, 28 extend downward from the horizontal surfaces created by the rim channel protector 24 and the stacking spacer 40. The inner rim lock 22 extends downward from the rim channel protector 24 along its entire innermost circumference. The inner rim lock 22 is slightly curved so as to capture and lock around the inner rim 52 of the paint container 12. The lower outer flange 28 extends downward from the stacking spacer 40 along its entire curved outermost circumference. The lower outer flange 28 along with the stacking spacer 40 captures the upper outer rim 50 of the paint container 12. The lower outer flange 28 tapers toward a thin free edge away from the stacking spacer 40 which allows for slight tolerance variations of the upper outer rim 50. The lower outer flange 28 extends downward slightly further than the inner rim lock 22 to ensure the pour spout 10 is properly centered on the paint container 12 prior to engagement of the inner rim lock 22. The inner rim lock 22 is engaged by applying minimal downward force in a circular manner along the uppermost surface of the rim channel protector 24.

Extending vertically upward from the stacking spacer 40 is the pour trough 20. The pour trough 20 reaches approximately one-half of the way around the outermost circumference of the pour spout 10 and occupies an area around the circumference not occupied by the brush wipe 36 and opposite the pull-tab 38. The unsupported free edge of the pour trough 20 is curved and shaped to facilitate pouring of a liquid from the paint container 12. The outermost free edge of the pour trough 20 has a reverse curve to form a control trough 30. The control trough 30 helps to direct the paint out of the pour spout 10 in a controlled manner. On the exterior edge of the control trough 30, a drip lip 32 is provided so as to prevent paint from flowing back over the graphics surface 34 and onto the generally cylindrical can body 60. The graphics surface 34 provides an area on the pour spout 10 for printed or embossed type graphics. Also extending vertically upward from the stacking spacer 40 is the upper flange 26. The upper flange 26 reaches approximately halfway around the outermost circumference of the pour spout 10 and occupies the area around the circumference not occupied by the pour trough 20.

Figure 6:
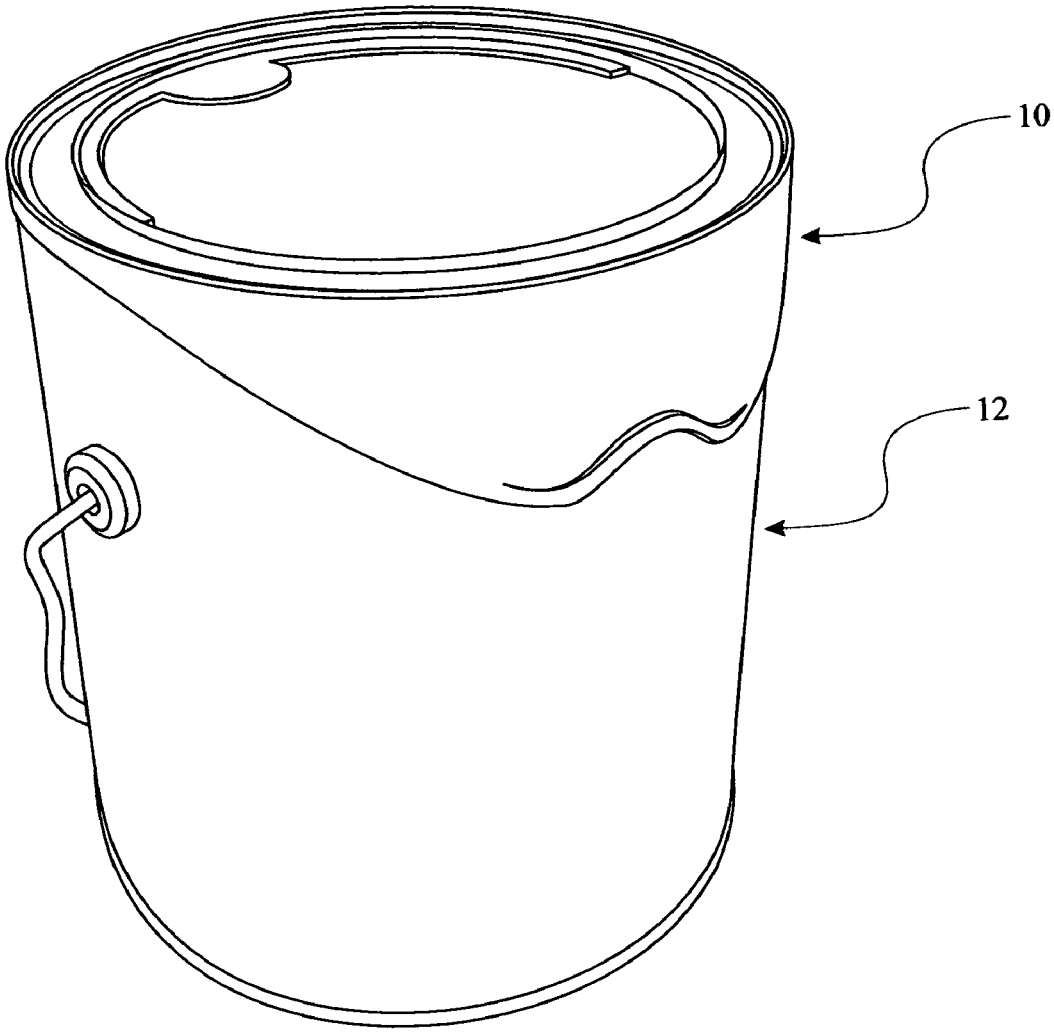
FIG. 6 is a perspective view of the spout in the stored position.
Figure 7:
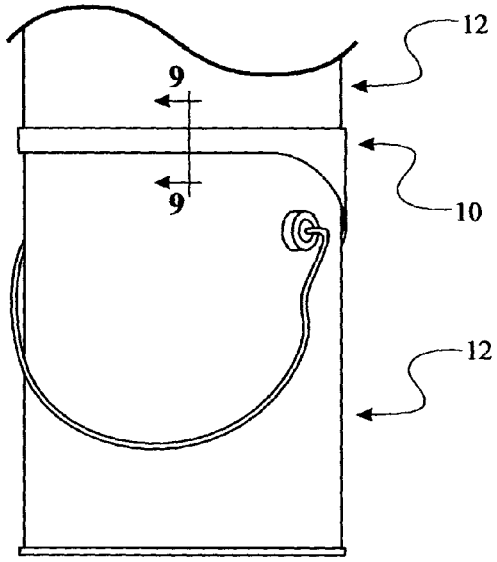
FIG. 7 is a side view of the spout in the stored position with a second can stacked above.
Figure 8:
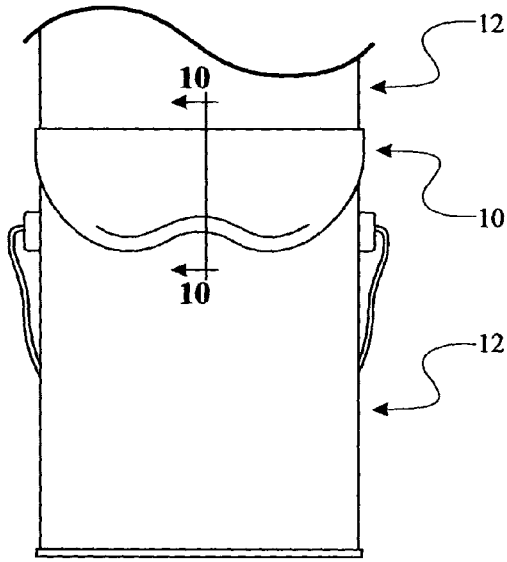
FIG. 8 is a front view of the spout in the stored position with a second can stacked above.
Figure 9:
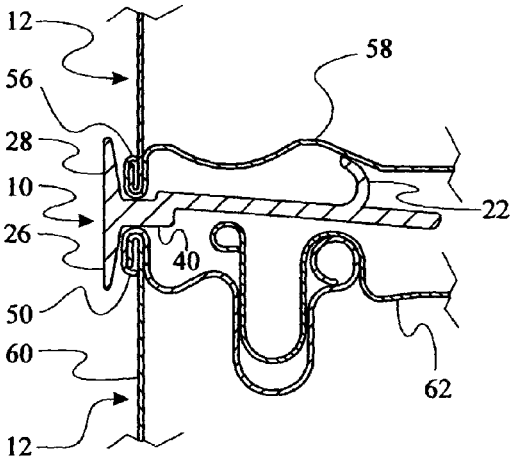
FIG. 9 is a sectional view along 9—9 of FIG. 7.
Figure 10:
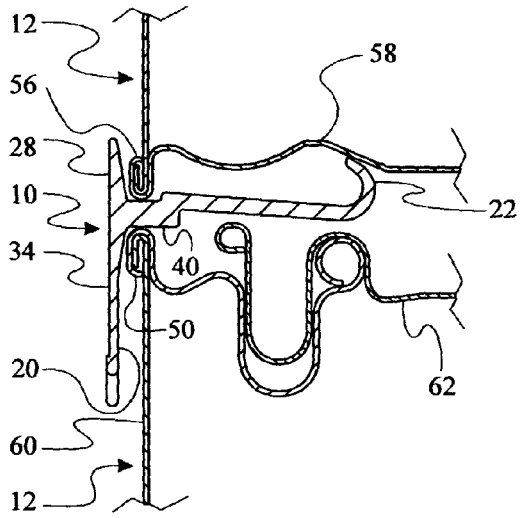
FIG. 10 is a sectional view along 10—10 of FIG. 8.

FIG. 6 depicts the present invention in the stored position. When the pour spout 10 is installed in the stored position as shown in FIG. 7 through FIG. 10, the upper flange 26 along with the stacking spacer 40 captures the upper outer rim 50 of the paint container 12. The upper flange 26 is slightly thinner at the free edge away from the stacking spacer 40 that allows for slight tolerance variations of the upper outer rim 50. In the stored position, the pour trough 20 extends downward with its surface parallel to the generally cylindrical can body 60. In this position, the graphics surface 34 is oriented in the appropriate manner to display logos, graphics and the like. In the stored position, the lower outer flange 28 and the inner rim lock 22 project upward. The lower outer flange 28 will capture the lower rim 56 of a second paint container 12 if placed concentrically on top. The weight of a second paint container 12 on top is transferred from the lower rim 56 into the stacking spacer 40 and then into the upper outer rim 50 of the paint container 12 below. The inner rim lock 22 has the ability to deflect downward if contacted by the can bottom 58. When the pour spout 10 is in the stored position, the opening of the lower paint container 12 is generally sealed tightly with the metal press-on lid 62.

Figure 11:
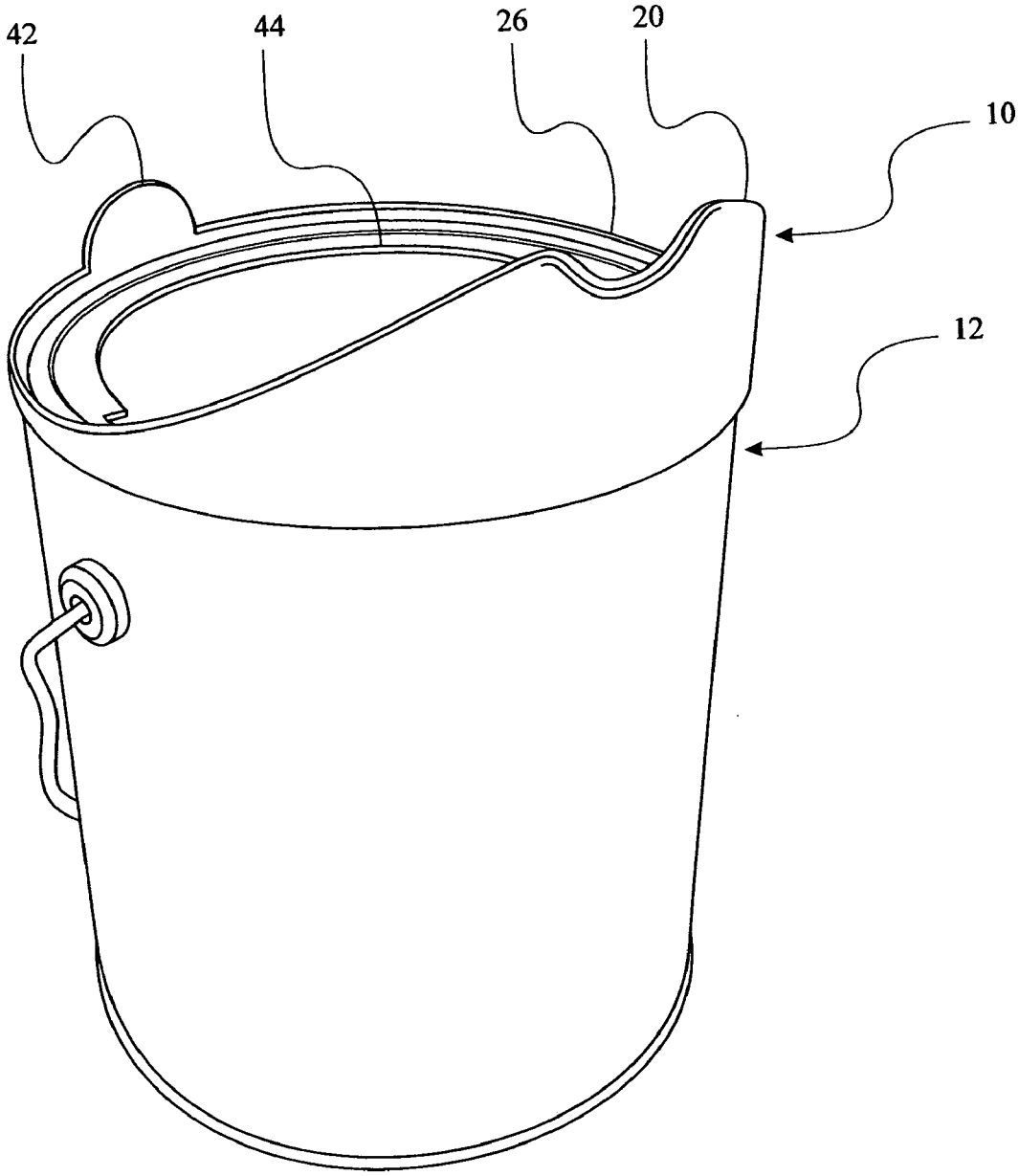
FIG. 11 is a perspective view of a second embodiment of the spout shown in the pour position.

FIG. 11 depicts the pour spout 10 with an alternate configuration for the pull-tab 42. While in the pour position, the pull-tab 42 projects upward in the same manner and around the same circumference as the pour trough 20. When this alternate configuration is placed in the stored position, it is evident that there is no longer a need for the upper flange 26 as the pour trough 20 and the pull-tab 42 capture the paint container 12 on two opposing sides. In addition, the brush wipe 36 can be combined into a single wipe 44 and extend continuously opposite the pour trough 20.

Figure 12:
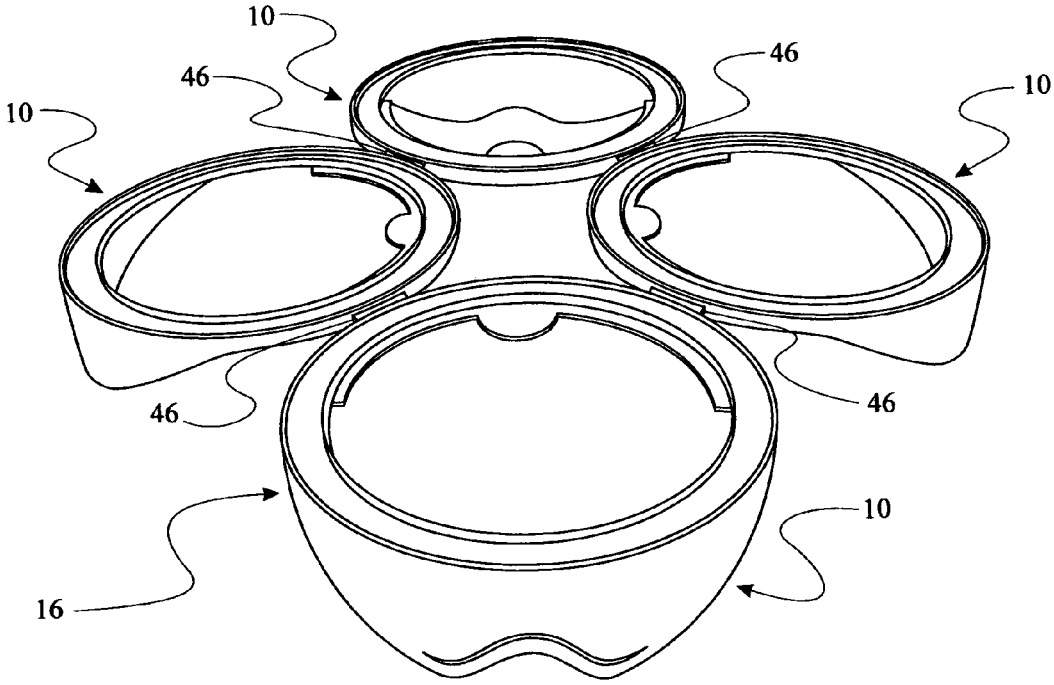
FIG. 12 is a perspective view that illustrates a method of connecting a set of pour spouts together.

FIG. 12 depicts the present invention in a set of four (4), which are attached by four (4) connectors 46. The connectors 46 are comprised of the same material as the pour spout 10 and are located 90 degrees apart at the two points around the circumference defined by the least distance to the adjoining adjacent pour spouts. The connectors 46 may be of slightly less thickness to facilitate easy detachment. The four (4) connectors 46 create a structural framework 16 of four interconnected spouts. It will be appreciated that applying the framework 16 to a like number of paint containers will structurally maintain the position of the paint containers so that a shrink or plastic wrap can be applied to the bundle prior to shipment.

Figure 13:
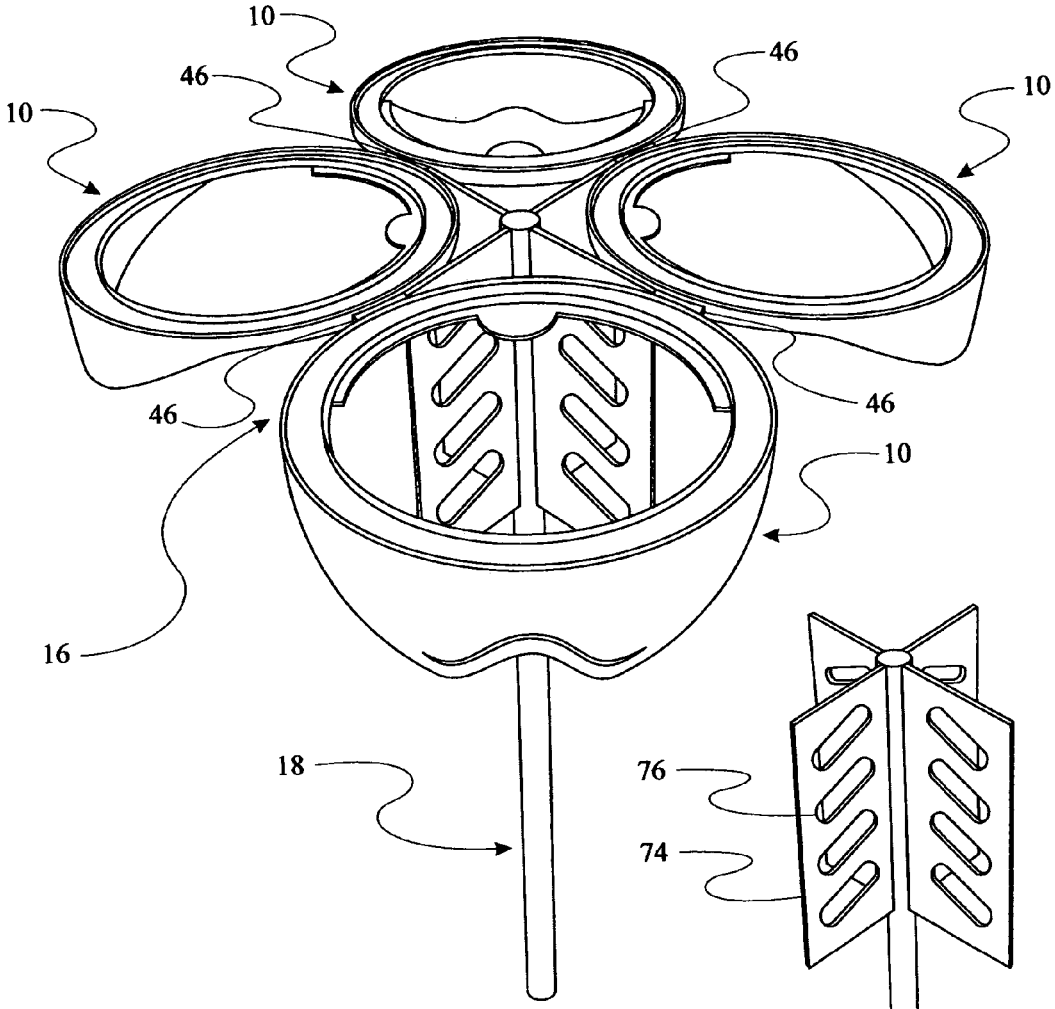
FIG. 13 is a perspective view of an optional stir paddle integrated into the assembly depicted in FIG. 12.

FIG. 13 depicts the structural framework 16 with the addition of a stir-paddle 18. The stir-paddle 18 provides additional stability to support the sides of the containers when they are bundled together. After shipment, the stir-paddle 18 can be easily detached and used in conjunction with an electric drill to assist in mixing the contents of the container 12.

Figure 14:
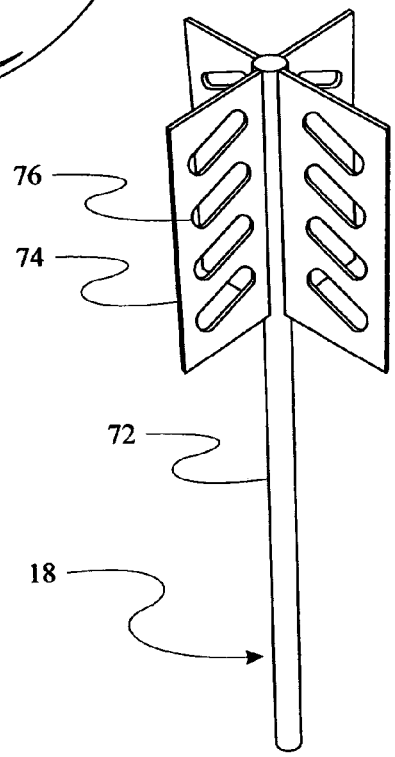
FIG. 14 is a perspective view of the stir paddle detached from the spout assembly depicted in FIG. 13.

FIG. 14 illustrates the stir-paddle 18 after it has been detached from the structural framework 16. The stir-paddle 18 consists of a circular or hexagonal shaft 72 the length of which is slightly less than the height of the container 12. The diameter of the shaft 72 is approximately 6 mm, however other practical diameters may be used that are compatible with a standard electric hand drill. At the upper end of the shaft, four blades 74 project radially outward to a distance at which they may be conveniently attached to the connectors 46 of the structural framework 16. The height of the blades 74 shall be sufficient to provide support to the bundled containers as well as allow for proper mixing of the contents of the container 12. Each of the blades 74 has several openings 76 where material has been eliminated from the blade 74. The openings 76 may be comprised of parallel cutouts as illustrated or any other shape whereby enough material is left remaining in the blade to provide support to the bundled containers as well as allow for proper mixing of the contents of the container 12.

It will be appreciated that the pour spout 10 of the disclosed embodiments provides numerous advantages over the prior art pour spouts. First, the pour spout of the present invention eliminates the liquid contents from dripping down the exterior surface of the can when transferring paint by either brush or pour. This is accomplished while adequately and completely sealing off the groove formerly occupied by the lid and the contents of the container are exposed. Second, the spout can easily be removed by means of a pull-tab without transfer of wet paint to the hands or adjacent surfaces. Third, when the spout is not in use, it may be stored integrally on the container in an inverted position; thus reducing storage space and eliminating the possibility of misplacement. Fourth, the interlocking feature of the pour spout facilitates a neat and safe storage of additional containers by means of a structural interlock. Fifth, by providing a means to structurally interconnect several cans in a bundle to facilitate shipping and eliminate the need for cardboard boxes or trays thus reducing shipping costs. The addition of a stir-paddle may be incorporated into the interconnected framework to assist in container separation and structural integrity of the bundle for shipment. The stir-paddle can also be removed by the end user to assist in mixing the contents of the container. Lastly, the spout of the present invention provides for a surface to display advertising that may be displayed on the container without affecting the label provided on the can by the manufacturer.

While the preferred embodiment has been disclosed with respect to a paint can, it will be appreciated that the design is equally applicable to other types and sizes of containers that have a liquid contents such as stains, solvents, cleaners and the like.

Finally, it will be understood that the preferred embodiment has been disclosed by way of example, and that other modifications may occur to those skilled in the art without departing from the scope and spirit of the appended claims.

What is clamed is:

1. A pour spout to assist in pouring a liquid from a container including a body having a top opening circumscribed by a rim channel for holding a lid covering said top opening, an inner rim inward of said rim channel, and an outer rim outward of said rim channel, said pour spout comprising:

a generally horizontally extending channel cover for covering said rim channel after a lid covering said top opening is removed from said rim channel, thereby to prevent liquid from dripping into said rim channel after said liquid is removed from said container, a locking flange extending downward of said channel cover, said locking flange being adapted to extend downwardly adjacent said inner rim interiorly thereof, a lower outer flange extending downwardly of said channel cover, said lower outer flange being adapted to extend exteriorly of said outer rim, an imperforate liquid control trough extending generally vertically and upwardly of said channel cover, and an upper flange extending unwardly of said lower outer flange and upwardly of said channel cover, said upper flange extendinig around a circumference of the pour spout in an area around the circumference not occupied by the liquid control trough, the liquid control trough extending vertically upwardly of the upper flange.

2. The pour spout of claim 1, comprising a flexible and resilient plastic material.

3. The pour spout of claim 2, wherein said flexible and resilient plastic material comprises polypropylene.

4. The pour spout of claim 1, wherein said outer flange is tapered to a reduced thickness at a free end spaced from said channel cover.

5. The pour spout of claim 1, wherein said locking flange comprises a curved inner rim lock for snapping into engagement with said inner rim.

6. The pour spout of claim 1, wherein said outer flange further comprises an upper flange extending upwardly of said channel cover around a circumference of the pour spout in an area of the circumference not occupied by the liquid control trough, said liquid control trough extending upwardly of the upper flange.

7. The pour spout of claim 6, wherein said upper flange is tapered to a reduced thickness at a free end spaced from said channel cover.

8. The pour spout of claim 1, wherein said liquid control trough comprises a generally vertical convex exterior surface.

9. The pour spout of claim 1, wherein when said pour spout is inverted over said top opening, said outer flange extends upwardly of said outer rim, thereby enabling a second container to be stacked above said container.

10. The pour spout of claim 1, wherein said pour spout further comprises a horizontally extending stacking spacer adjacent said outer flange and having greater thickness than said channel cover, said stacking spacer evenly distributing weight of a second container stacked over said container.

11. The pour spout of claim 1, further comprising a pull tab comprising a web extending radially inward of said channel cover, opposite said liquid control trough.

12. The pour spout of claim 11, further comprising a curved brush wipe extending inwardly of said channel cover, said brush wipe being located at a position along said channel cover not occupied by said pour trough or said pull tab.

13. A carrier for a plurality of cylindrical containers, said carrier comprising a plurality of pour spouts in accordance with claim 1, each said pour spouts being attached to at least one adjacent pour spout by a connector integrally formed therewith.

14. A carrier in accordance with claim 13, wherein each said connector is sufficiently thin to facilitate separation of said pour spouts via a knife, scissors, or tearing.

15. A carrier in accordance with claim 13, further comprising a stir paddle integrally formed with said pour spouts.

16. A carrier in accordance with claim 15, wherein said pour spout includes a shaft and a plurality of blades extending radially outwardly of said shaft, said shaft being suitable for connection with an electric drill in order to mix paint or other liquid.

17. A paint container including a body having a top opening circumscribed by a rim channel holding a lid, an inner rim radially inward of said rim channel, and an outer rim radially outward of said rim channel, said container including a pour spout shaped in accordance with claim 1 and inverted so that said upper flange and said liquid control trough extend downwardly adjacent an exterior of said container body, said liquid control trough extending vertically downwardly of said upper flange.

18. The paint container of claim 17 wherein said liquid control trough includes an outer convex surface displaying graphic matter.

19. A pour spout to assist in pouring a liquid from a container including a body having a top opening circumscribed by a rim channel for holding a lid covering said top opening, an inner rim inward of said rim channel, and an outer rim outward of said rim channel, said pour spout comprising:

a channel cover for covering said rim channel after a lid covering said top opening is removed from said rim channel, thereby to prevent liquid from dripping into said rim channel after said liquid is removed from said container, an outer flange extending downwardly of said channel cover, said outer flange being adapted to extend exteriorly of said outer rim, an imperforate liquid control trough attached to the channel cover and extending generally vertically and upwardly thereof, said liquid control trough having an outermost free edge including a reverse curve defining an arcuate trough indented downwardly from said outermost free edge, and a horizontally extending stacking spacer adjacent said outer flange and having greater thickness than said channel cover, said stacking spacer distributing weight of a second container stacked over said container.

20. The pour spout of claim 19, wherein said pour spout further comprises an arcuate drip lip extending exteriorly of said generally vertical convex exterior surface below said arcuate trough and upwardly of said channel cover, said drip lip preventing liquid poured from said container from being transferred onto said convex exterior surface.

* * * * *